US007862206B2

(12) United States Patent
Chen et al.

(10) Patent No.: US 7,862,206 B2
(45) Date of Patent: Jan. 4, 2011

(54) ADJUSTABLE LIGHT-EMITTING DIODE DISPLAY MODULE

(75) Inventors: Shun-Chih Chen, Hsinchu (TW); Wan-Chih Lin, Hsinchu (TW)

(73) Assignee: Opto Tech Corporation, Hsinchu (TW)

( * ) Notice: Subject to any disclaimer, the term of this patent is extended or adjusted under 35 U.S.C. 154(b) by 121 days.

(21) Appl. No.: 12/406,946

(22) Filed: Mar. 18, 2009

(65) Prior Publication Data

US 2010/0238663 A1 Sep. 23, 2010

(51) Int. Cl.
*F21V 21/00* (2006.01)

(52) U.S. Cl. ..... 362/249.03; 362/419

(58) Field of Classification Search ..... 362/249.01–249.14, 418, 419
See application file for complete search history.

(56) References Cited

U.S. PATENT DOCUMENTS 6,299,330 B1 * 10/2001 Michl et al. ..... 362/239
7,726,839 B2 * 6/2010 Chien ..... 362/249.03
7,726,841 B2 * 6/2010 Chien ..... 362/249.07
2008/0068838 A1 * 3/2008 Galke et al. ..... 362/250

* cited by examiner

*Primary Examiner*—John A Ward

(57) ABSTRACT

An adjustable LED display module is provided, including a plurality of light-emitting units, and at least a set of spacing adjusting mechanism. The spacing adjusting mechanism is of a retractable grid-like structure or a retractable mesh-structure. The plural light-emitting units are distributed on different locations of the components of the spacing adjusting mechanism. When the spacing adjusting mechanism operates to adjust the spacing, at least spacing between some neighboring light-emitting units will change so that the location after adjustment will vary. Hence, the display module will have different form factor and light dots arrangement to provide higher flexibility for various application environments and conditions as well as convenience for storage and transportation when contracted.

5 Claims, 9 Drawing Sheets

ADJUSTABLE LIGHT-EMITTING DIODE DISPLAY MODULE

FIELD OF THE INVENTION

The present invention generally relates to a light-emitting diode (LED) display module, and more specifically to an LED display module with adjustable spacing between light-emitting units, and able to form a large display screen with a plurality of adjustable display modules.

BACKGROUND OF THE INVENTION

The conventional LED display screens are mostly of box-based structure, mainly used in stage performance, concert and other events. The spacing between the light dots in each box module is fixed; thus, the fixed resolution for the box module. Usually, a large display screen is made up of a plurality of box modules, combined with power supply, control device, software and so on, so that a screen can operate in coordination to show the image and lighting.

The box module has a bulky and heavy structure; therefore, the assembly and setup will take up a lot of space. Also, as the box module is of fixed size, the large display screen formed with a fixed number of box modules will stay fixed, and is not adjustable according to the stage. Other disadvantages of box-based display modules include the transportation and storage, also related to the bulky and heavy structure.

SUMMARY OF THE INVENTION

The primary object of the present invention is to provide an adjustable LED display module, by using a spacing adjusting mechanism to adjust the spacing between the plural light-emitting units of the module so that the locations of the light-emitting units distributed on the spacing adjusting mechanism will vary. A large display screen can be formed by one or more display modules. Operating with software to control the lighting conditions of the light-emitting units, the adjustable LED display module provides more flexibility in different application environments and conditions, such as brightness, screen size, light dot spacing, viewing see-through, and so on.

Another object of the present invention is to provide an LED display module that is easy for setup and storage. As the spacing adjusting mechanism can expand and contract, the LED display module can be contracted into a smaller size easy for storage.

To achieve the above objects, the present invention provides an adjustable LED display module, including a plurality of light-emitting units, and at least a set of spacing adjusting mechanism. The spacing adjusting mechanism is of a retractable grid-like structure or a retractable mesh-structure. The light-emitting unit includes red LED, green LED and blue LED. The plural light-emitting units are distributed on different locations of the components of the spacing adjusting mechanism. When the spacing adjusting mechanism operates to adjust the spacing, at least spacing between some neighboring light-emitting units will change so that the location after adjustment will vary. Hence, the display module will have different form factor and light dots arrangement.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENTS

Figure 1:
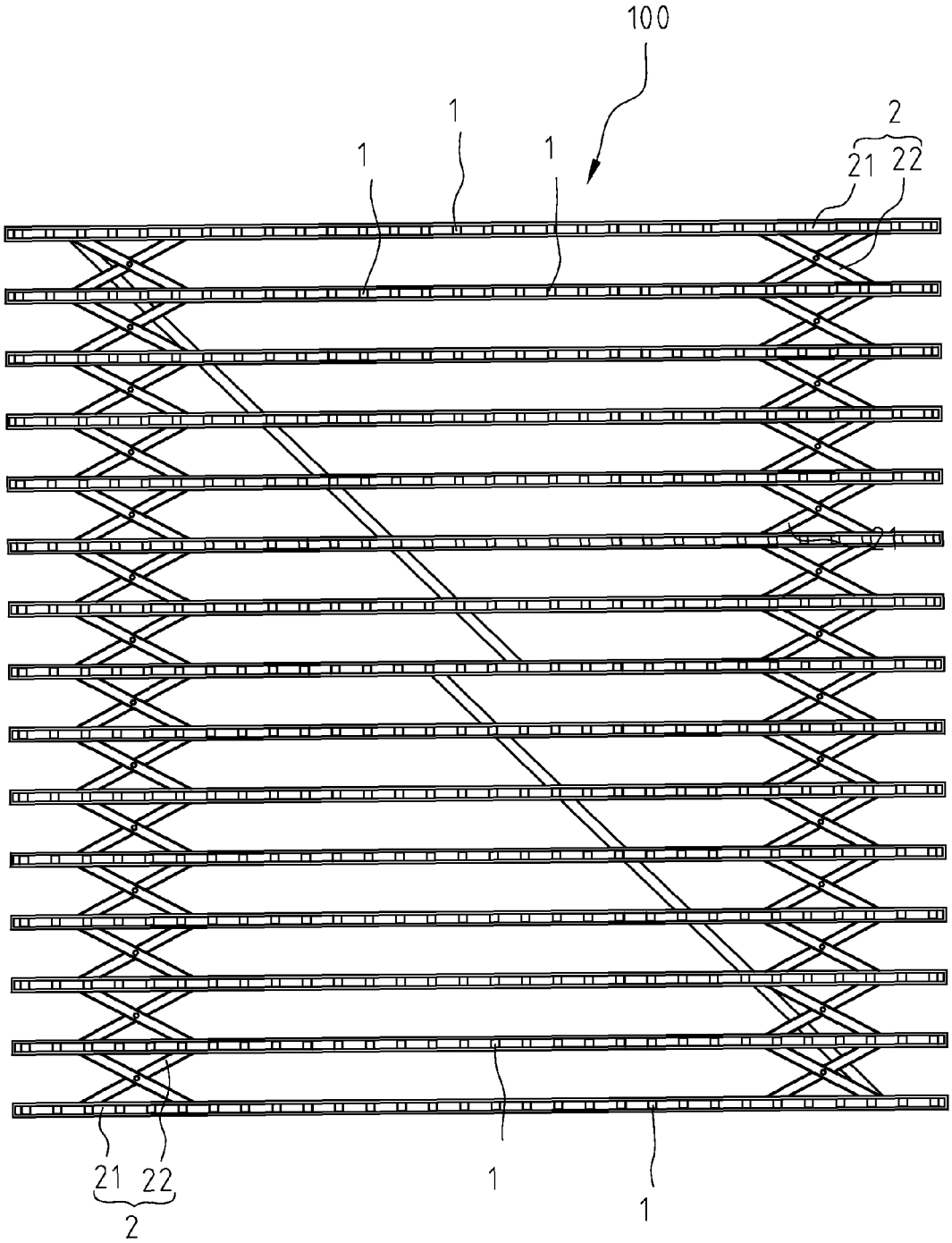
FIG. 1 shows a schematic view of the present invention in expansion condition.
Figure 2:
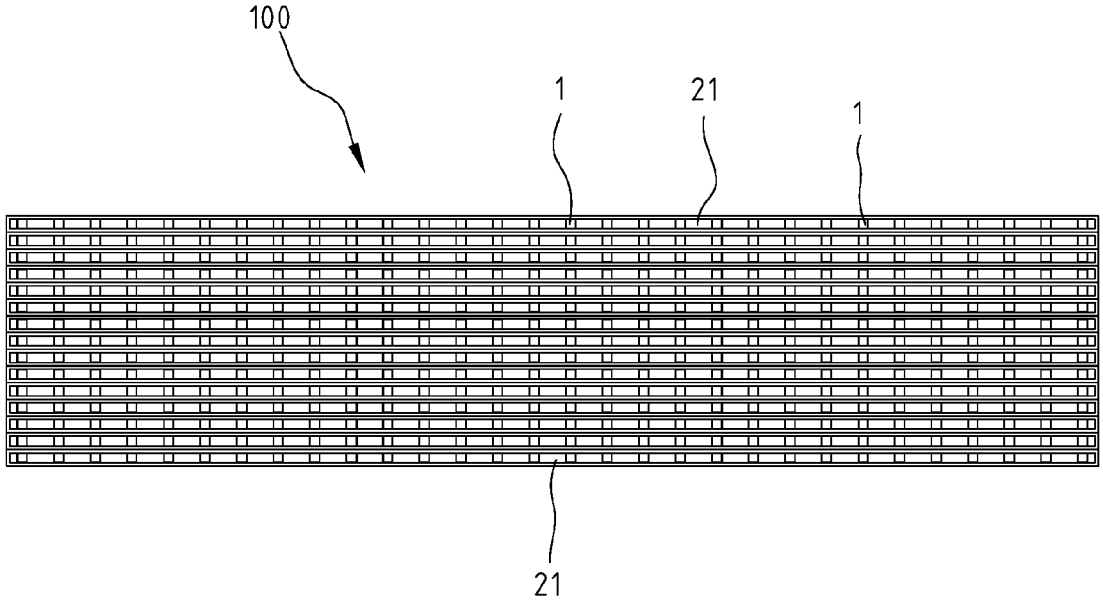
FIG. 2 shows a schematic view of the present invention in contraction condition.

FIG. 1 and FIG. 2 show schematic views of an adjustable LED display module of the present invention in expansion and in contraction condition, respectively. As shown in FIG. 1 and FIG. 2, an LED display module 100 includes a plurality of light-emitting units 1, and at least a set of spacing adjusting mechanism 2. Plural light-emitting units 1 are distributed at different locations on the components of spacing adjusting mechanism 2. Spacing adjusting mechanism 2 presents a grid-like rectangle of different form factor as in expansion condition or in contraction condition, i.e., adjusted by spacing adjusting mechanism. When spacing adjusting mechanism 2 adjusts the spacing, at least the spacing between some light-emitting units 1 will change and the relative locations of the light-emitting units 1 will also change, so that at least the length or the width of display module 100 will change. Each light-emitting unit 1 includes a red LED, a green LED and a blue LED. Depending on the extent that spacing adjusting mechanism 2 expands or contracts, display module 100 will have different length or different width, with different distribution of light-emitting units 1 within the rectangle bounded by the length and the width. Hence, display module 100 can be adjusted to fit different environments and application conditions.

In the present invention, spacing adjusting mechanism 2 can be implemented with various structures. For example, the adjustment can be either single directional, single axial, bi-directional or bi-axial. The following describes various embodiments.

Figure 3:
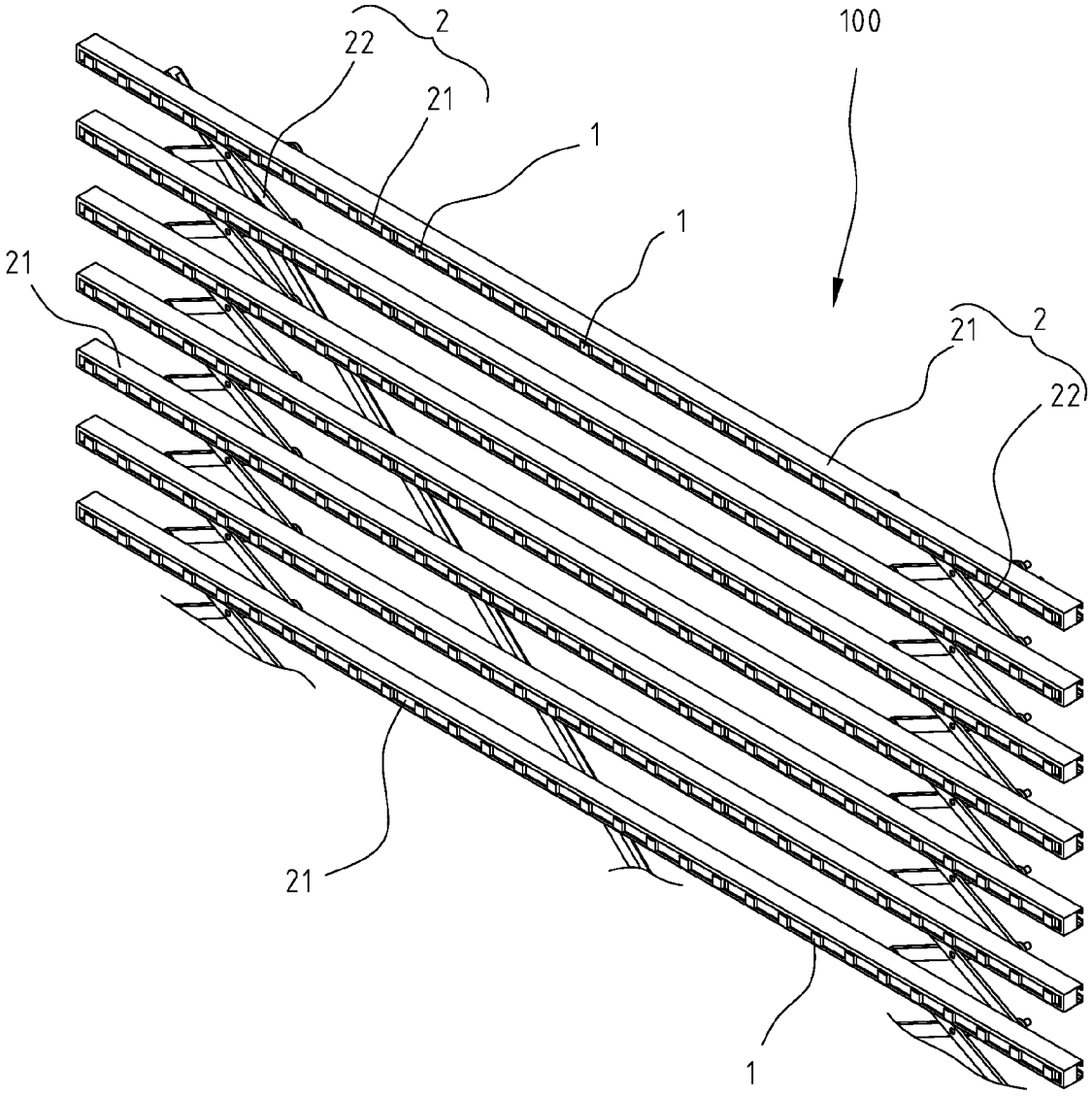
FIG. 3 shows a partial enlarged view of the first embodiment of the present invention.

FIG. 3 shows a partial enlarged view of the first embodiment of the present invention. In this embodiment, spacing adjusting mechanism 2 is a retractable grid-like structure, including a plurality of light fixture rack 21 and at least a set of linkage set 22. Linkage set 22 forms a cross and is connected to the back of light fixture rack 21 so that plural light fixture racks 21 can expand and contract along single axial in a retractable grid-like manner, with expansion condition as shown in FIG. 1 and contraction condition as shown in FIG. 2. Light fixture rack 21 is a long stripe, with plural light-emitting units 1 attached to the same side of light fixture rack 21. Any two neighboring light-emitting units 1 on the same light fixture rack 21 have the same spacing, and light-emitting unit 1 is the pixel (light dot) of the formed display screen.

In this embodiment, linkage set 22 forms a cross to ensure that light fixture racks 21 can move in parallel with each other.

Thus, in this embodiment, the spacing between light-emitting units 1 on the same rack is fixed, while the spacing between two racks 21 can be adjusted according to the angle of the cross of linkage set 22. In other words, display module 100 of this embodiment can only be adjusted in one direction. In addition, the line connecting light-emitting units 1 is hidden inside light fixture rack 21, and is connected to a power supply, control device, and so on (not shown). In this manner, when the spacing changes, display module 100 can still operate. A large size display screen can be formed with one or more LED display modules 100 of the present invention.

With this, the LED display module of the present invention can be adjusted and arranged to form different display screen sizes and light conditions to fit various application environment.

Figure 4:
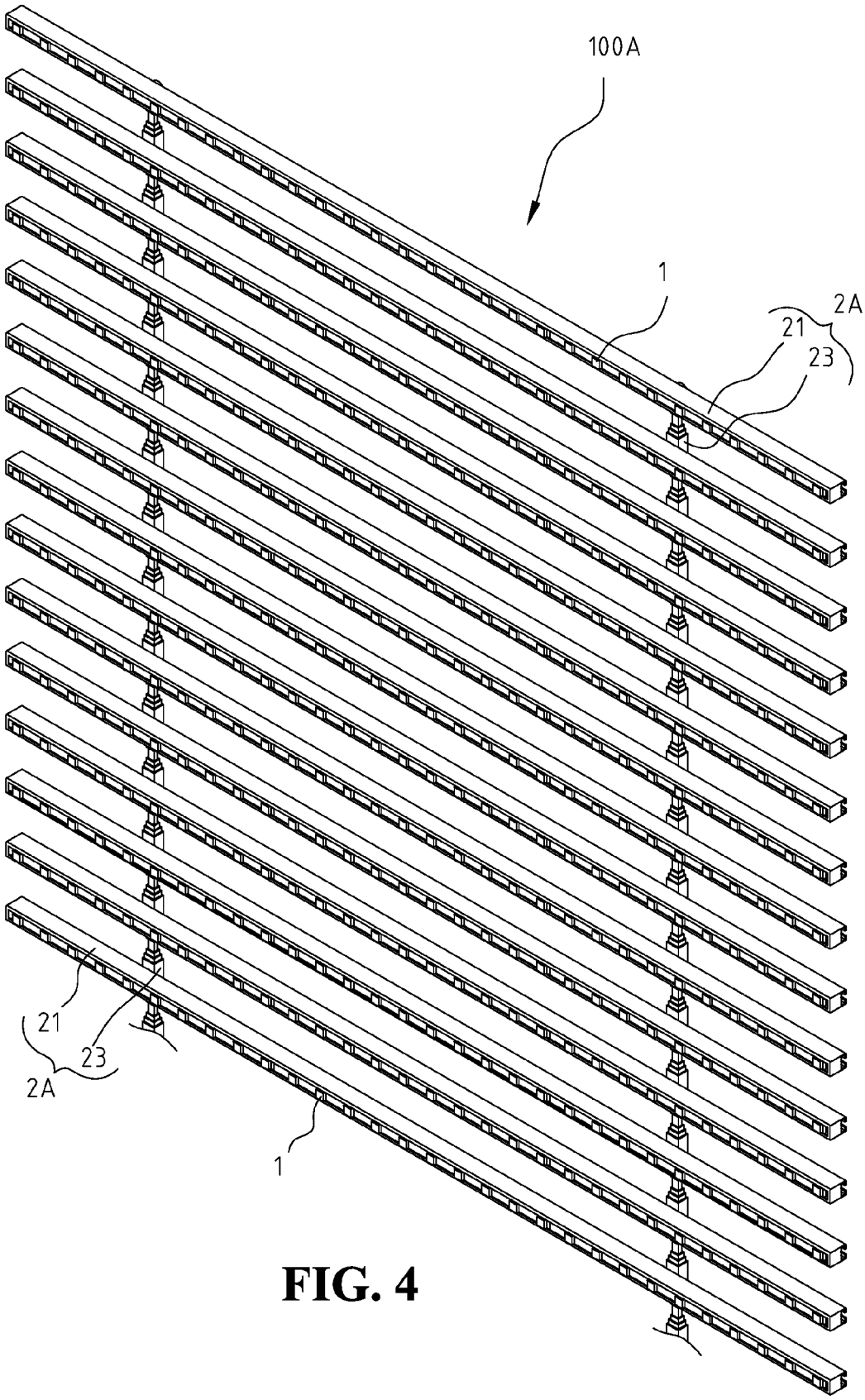
FIG. 4 shows a schematic view of the second embodiment of the present invention.

In the first embodiment, spacing adjusting mechanism 2 is a retractable grid-like structure with plural light fixture racks 21 and at least a linkage set 22. But, the implementation of the spacing adjusting mechanism is not limited to the above embodiment. FIG. 4 shows a schematic view of the second embodiment of the present invention. In this embodiment, spacing adjusting mechanism 2A also has a retractable gird-like structure, but with a plurality of light fixture racks 21 and at least a set of retractable device 23. Plural light-emitting units 1 are attached to light fixture rack 21, and retractable device 23 enables plural light fixture racks 21 to move ups and downs so as to adjust the size of the actual use of display module 100A.

Figure 5A:
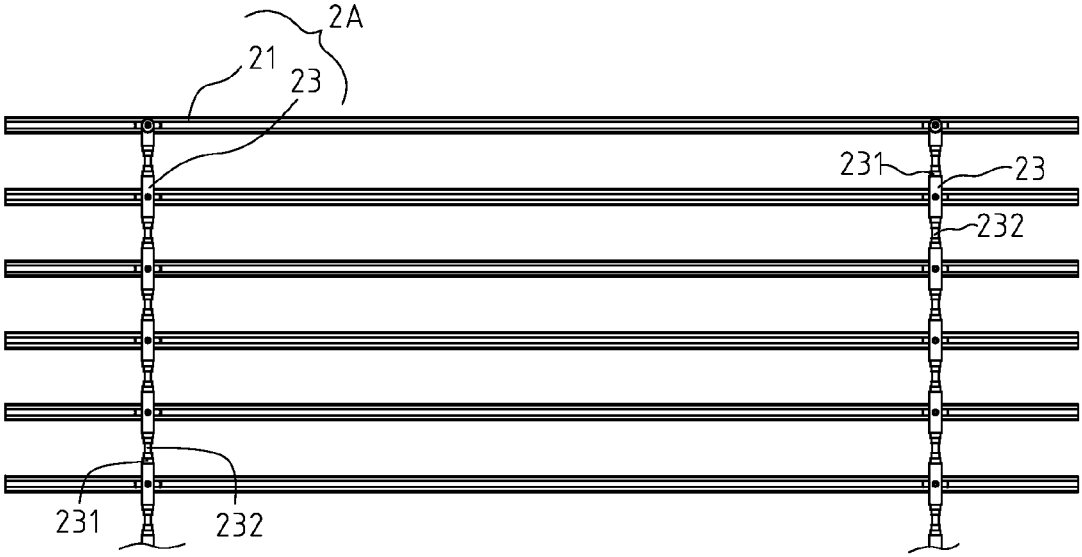
FIG. 5A shows a schematic rear view of structure of the light fixture rack of the second embodiment of the present invention in expansion condition.
Figure 5B:
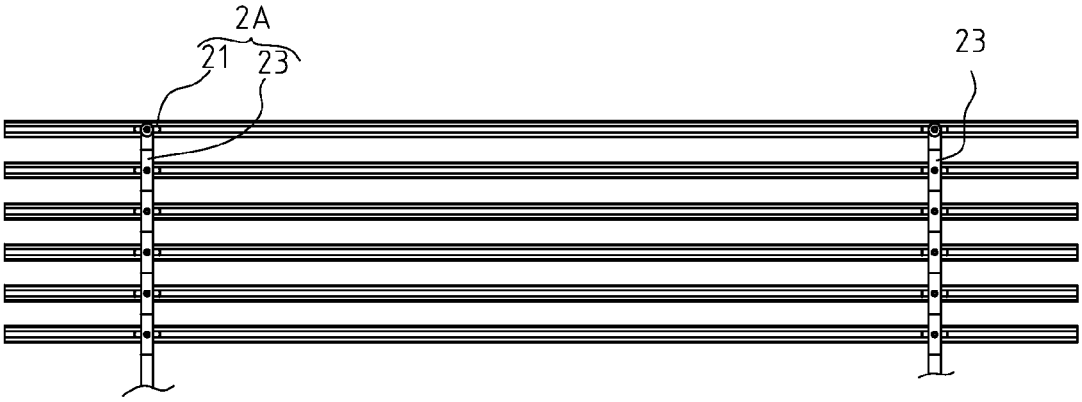
FIG. 5B shows a schematic rear view of structure of the light fixture rack of the second embodiment of the present invention in contraction condition.

FIG. 5A, shows an enlarged rear view of the structure of light fixture rack 21 of the second embodiment. In this embodiment, each light fixture rack 21 is connected to a retractable device 23 on the right and left side, respectively. Retractable device 23 includes a plurality of retractable rods 231, 232 of different length. Each retractable rod is sheathed together serially. To increase the spacing between two neighboring light fixture racks 21, the retractable rods are expanded, as shown in FIG. 5A. to decrease the spacing between two neighboring light fixture racks 21, the retractable rods are contracted so that retraction rods 231, 232 are hidden inside retractable device 23, as shown in FIG. 5B. With the mechanism shown in this embodiment, the length and the width of display module 100 can also be adjusted.

Figure 6:
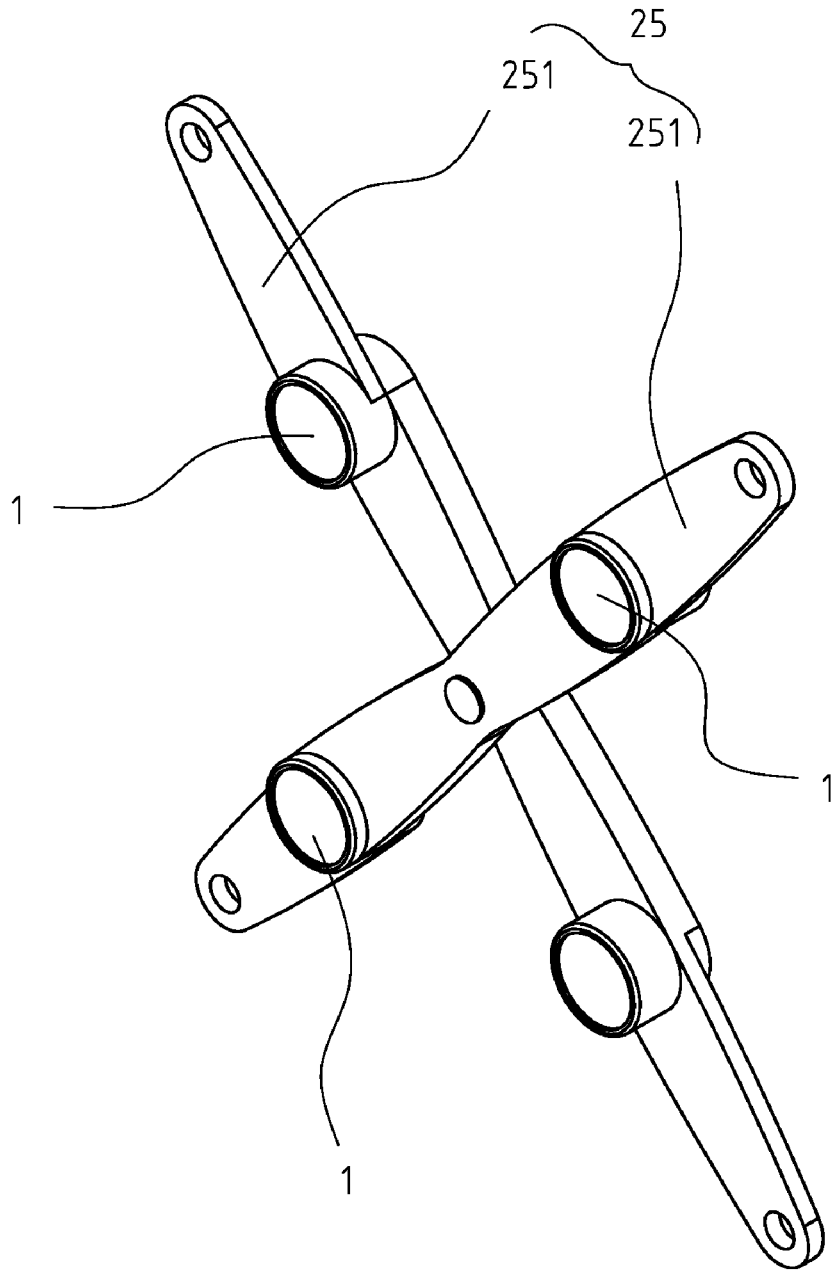
FIG. 6 shows a schematic view of the X-shape coupling unit of the third embodiment of the present invention.
Figure 7:
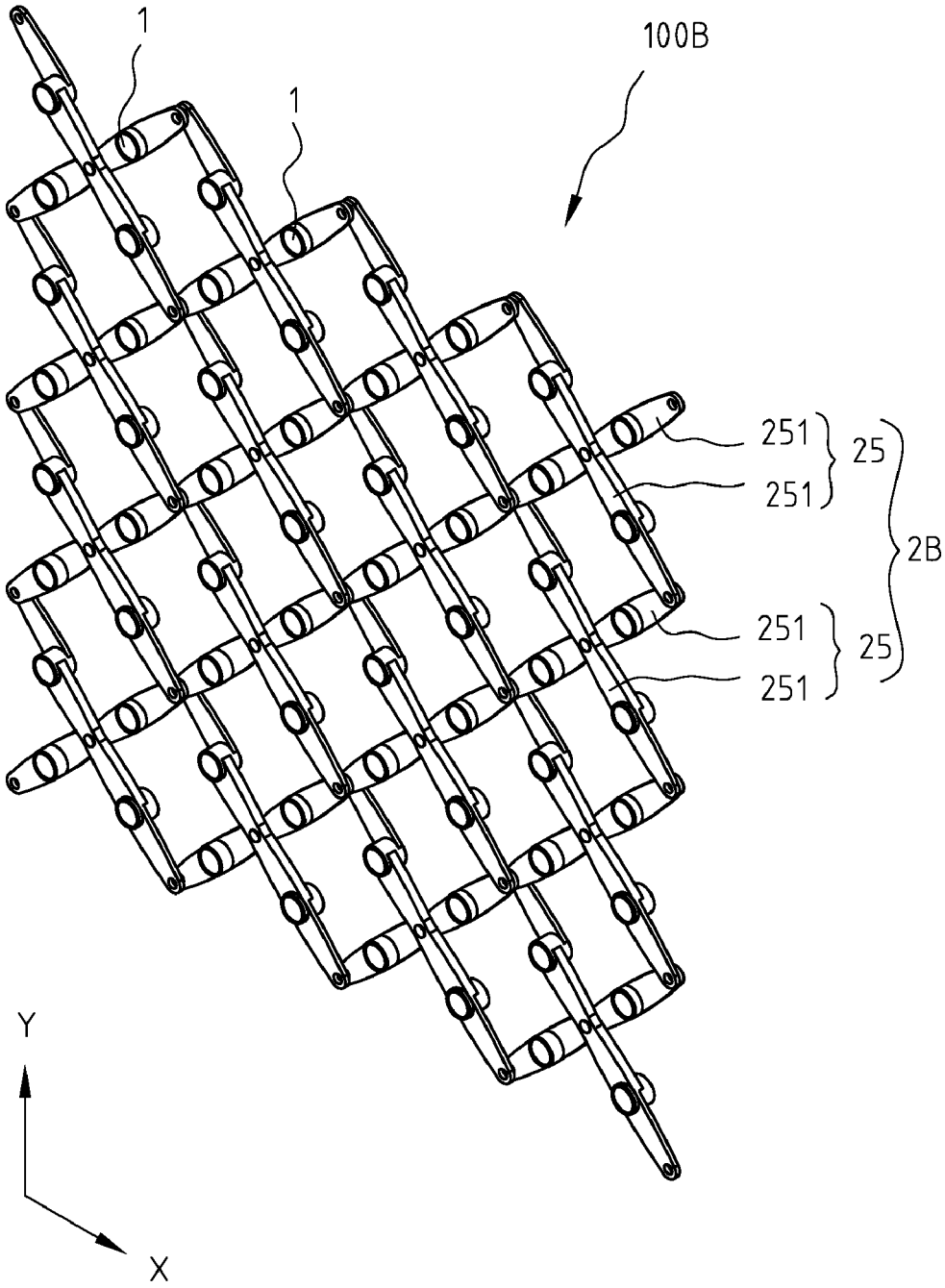
FIG. 7 shows a schematic view of the actual use of the third embodiment of the present invention.

FIG. 6 and FIG. 7 show the third embodiment of the present invention. In this embodiment, spacing adjusting mechanism 2B has a retractable mesh-like structure, including a plurality of X-shape coupling units 25. X-shape coupling unit 25 is formed by two linkage rods 251 at the middle of the rods. Each X-shape coupling unit 25 has plural light-emitting units 1 attached to the surface, shown as 4 light-emitting units in this embodiment, located at the middle point between the coupling point and the four endpoints, respectively. Spacing adjusting mechanism 2B is formed by a plurality of X-shape coupling unit coupling together to form a mesh-like structure.

Figure 8:
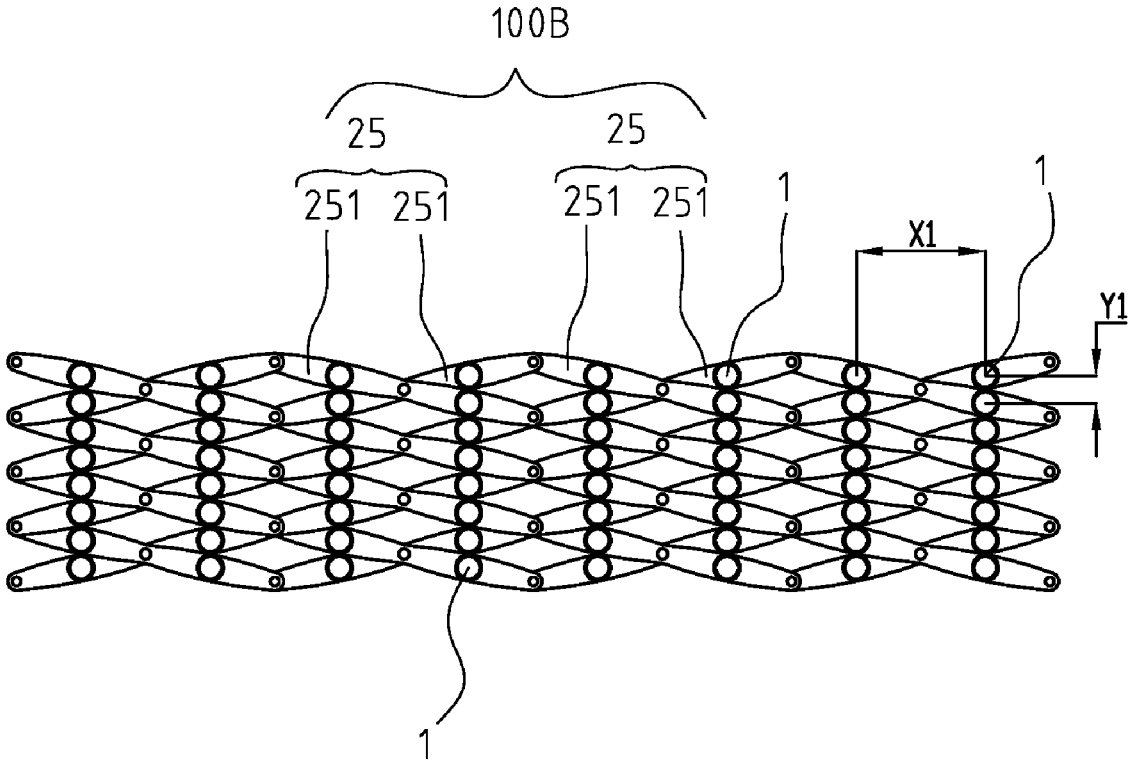
FIG. 8 shows a schematic view of the first adjustment condition of the third embodiment of the present invention.
Figure 9:
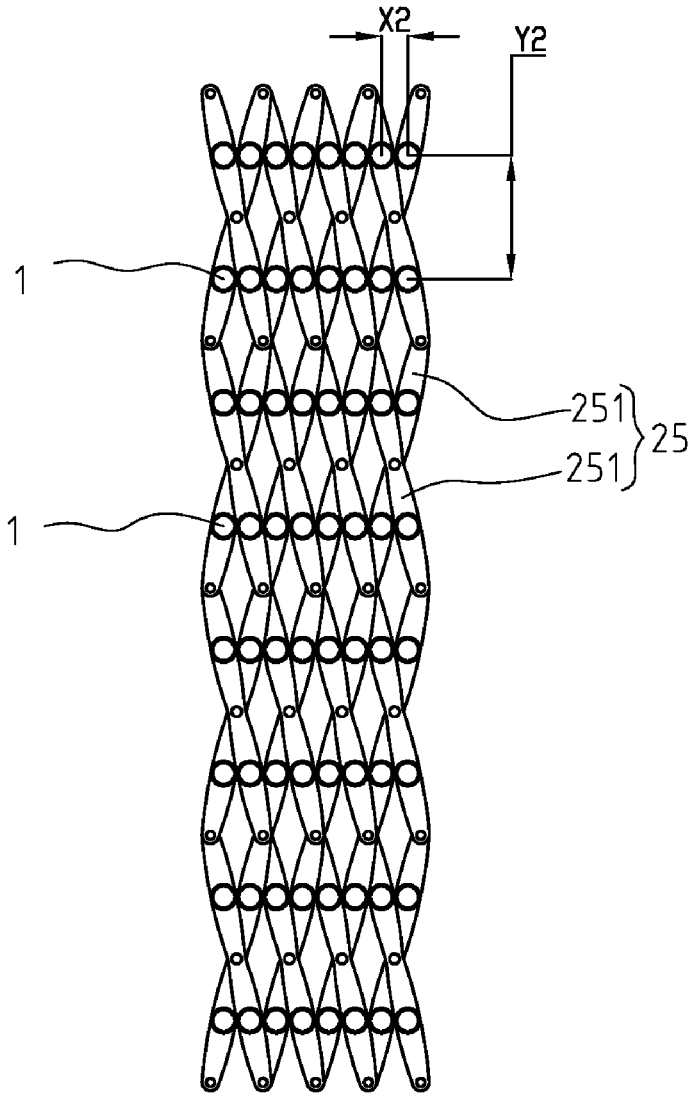
FIG. 9 shows a schematic view of the second adjustment condition of the third embodiment of the present invention.

In the third embodiment, when spacing adjusting mechanism 2B adjusts the spacing, both the x-axial spacing and the y-axial spacing between two neighboring light-emitting units will change. As shown in FIG. 7, when the angle between two linkage rods 251 of an X-shape coupling unit 25 is 45° , the x-axial spacing and the y-spacing between two neighboring light-emitting units 1 are the same, showing the largest expansion size of display module 100B. FIG. 8 shows that when the x-axial spacing X1 is the largest, the y-axial spacing Y1 is the minimum. Vice versa, FIG. 9 shows that when the y-axial spacing Y2 is the largest, the x-axial spacing X2 is the minimum. This embodiment shows that the spacing can be adjusted bi-axially. The related wiring, power supply and control device are not shown in the figures.

In summary, the present invention attaches plural light-emitting units to different locations on the components of the spacing adjusting mechanism, which can be a retractable grid-like structure or a retractable mesh-like structure. In this manner, the display module can be adjusted to fit different application environment, a plurality of display modules can be used to form a large size display screen and as the grid-like or mesh-like structure can be seen through when expanded, the present invention provides high flexibility. The retractable design allows easy assembly and setup as well as transportation and storage.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An adjustable light-emitting diode (LED) display module, comprising:

a plurality of light-emitting units; and at least a set of spacing adjusting mechanism for changing spacing between some of said light-emitting units so that said LED display module can change length or width, said light-emitting units being distributed to different locations on components forming said spacing adjusting mechanism;

wherein said spacing adjusting mechanism has a retractable grid-like structure comprising a plurality of light fixture racks and at least one linkage set, said linkage set forms a cross and is connected to a back side of said light fixture racks so that said light fixture racks can expand and contract along a single direction in a retractable grid-like manner, and said light-emitting units are attached to a same side of said light fixture racks.

2. The adjustable LED display module as claimed in claim 1, wherein each of said light fixture racks has a plurality of light-emitting units equally spaced and attached to a surface of the light fixture rack.

3. The adjustable LED display module as claimed in claim 1, wherein each of said light-emitting units is an LED light source comprising red LED, green LED and blue LED.

4. An adjustable light-emitting diode (LED) display module, comprising:

a plurality of light-emitting units; and at least a set of spacing adjusting mechanism for changing spacing between some of said light-emitting units so that said LED display module can change length or width, said light-emitting units being distributed to different locations on components forming said spacing adjusting mechanism;

wherein said spacing adjusting mechanism has a retractable grid-like structure comprising a plurality of light fixture racks and at least one retractable device, said retractable device is connected to a back side of said light fixture racks, and said light-emitting units are attached to a same side of said light fixture racks.

5. The adjustable LED display module as claimed in claim 4, wherein each of said light-emitting units is an LED light source comprising red LED, green LED and blue LED.

* * * * *